United States Patent [19]

Ando

[11] 4,346,581

[45] Aug. 31, 1982

[54] APPARATUS FOR MANUFACTURING FITTINGS

[75] Inventor: Hiroyuki Ando, Komatsu, Japan

[73] Assignee: Kabushiki Kaisha Komatsu Seisakusho, Tokyo, Japan

[21] Appl. No.: 198,213

[22] Filed: Oct. 17, 1980

[30] Foreign Application Priority Data

Oct. 18, 1979 [JP] Japan ..... 54-133609

[51] Int. Cl.[3] ..... B21D 22/00

[52] U.S. Cl. ..... 72/347; 72/354; 72/431; 72/465

[58] Field of Search ..... 72/347, 348, 349, 356, 72/465, 466, 431, 358, 359, 357

[56] References Cited

U.S. PATENT DOCUMENTS

| | | | |
|---|---|---|---|
| 3,740,997 | 6/1973 | Blake et al. | 72/465 |
| 3,951,083 | 4/1976 | Hortig | 72/348 |
| 4,147,049 | 4/1979 | Bool et al. | 72/349 |

*Primary Examiner*—Leon Gilden

*Attorney, Agent, or Firm*—Armstrong, Nikaido, Marmelstein & Kubovcik

[57] ABSTRACT

An apparatus for manufacturing fittings in one press stroke comprising a bed, a lower die mounted on the bed, the lower die having formed therein a stepped bore adapted to receive a blank to be worked, a hollow knockout slidable in the stepped bore, a slide, a holder fixedly secured to the slide, a cylindrical member slidably fitted in the holder, an upper die mounted in the cylindrical member and having a bore formed therein, a punch fixedly secured to the slide and inserted in the bore of the upper die, a sleeve mounted on and around the punch, a cushion cylinder for biasing the upper die downwards, and an elastomer disposed around the sleeve between the holder and the upper die for biasing the latter downwards after the upper die is lowered on the lower die.

4 Claims, 8 Drawing Figures

APPARATUS FOR MANUFACTURING FITTINGS

BACKGROUND OF THE INVENTION

This invention relates to an apparatus for manufacturing copper fittings.

The fittings of the kind specified have heretofore been manufactured by a process of cutting a blank into a predetermined shape or by subjecting a round rod blank to a press work consisting of a plurality of, say, four work steps.

However, the former manufacturing process is disadvantageous in that it requires a large allowance for cutting and low yield of blanks is unavoidable, whilst the latter manufacturing process is disadvantageous in that its work efficiency is low because of the necessity of the press work comprising a plurality of work steps.

SUMMARY OF THE INVENTION

It is therefore an object of the present invention to provide an apparatus for manufacturing fittings which can overcome the above noted problems.

Another object of the present invention is to provide a press apparatus which is capable of manufacturing a fittings in a single press stroke.

In accordance with an aspect of the present invention, there is provided an apparatus for manufacturing fittings, comprising: a bed; a lower die mounted on said bed, said lower die having formed therein a stepped bore adapted to receive a cylindrical blank to be worked; a hollow knockout slidably mounted in said stepped bore; a slide; holder means fixedly secured to said slide, said holder means having a first bore formed therein; a cylindrical member slidably fitted in said holder means; an upper die mounted in said cylindrical member, said upper die having a second bore formed therein; a punch fixedly secured to said slide and inserted in the first and second bores of said holder means and said upper die; a sleeve mounted on and around said punch; cushion cylinder means for biasing said sleeve and said upper die downwards; and elastomer means disposed around said sleeve between said holder means and said upper die for biasing said upper die downwards after said upper die is lowered on said lower die.

The above and other objects, features and advantages of the present invention will be readily apparent from the following description taken in conjunction with the accompanying drawings.

DESCRIPTION OF THE PREFERRED EMBODIMENT

Figure 1:
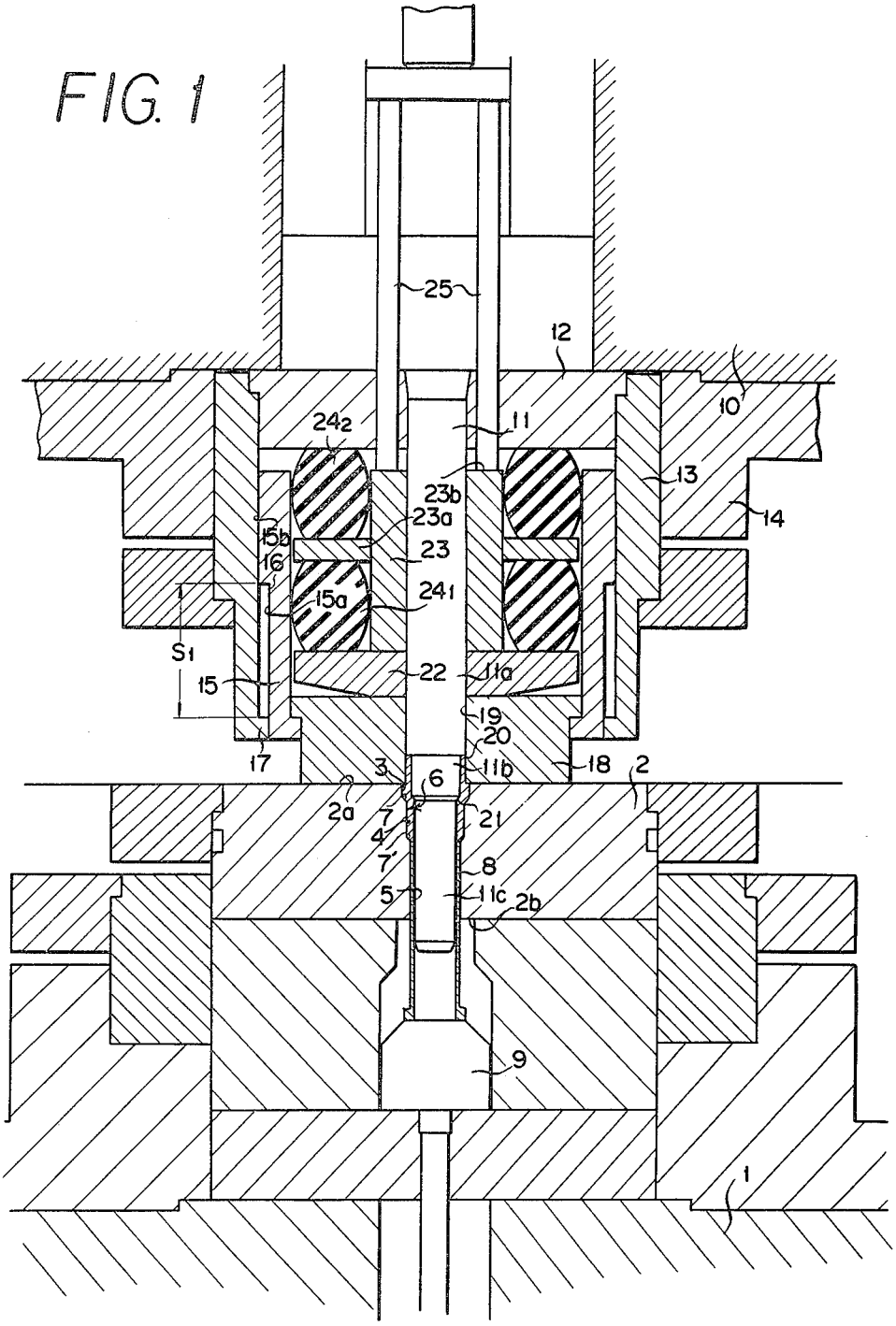
FIG. 1 is a longitudinal cross-sectional view of an apparatus for manufacturing fittings according to the present invention.

The press machine of the present invention will now be described in detail below with reference to the accompanying drawings. Referring to FIG. 1, reference numeral 1 denotes a bed on which a lower die 2 is mounted. The lower die 2 has formed therein a stepped bore 6 which comprises an upper section 3 of hexagonal cross-section opening at the upper end face 2*a* thereof, an intermediate section 4 and a lower section 5 of a small diameter. An inclined face 7 is formed between the upper section 3 and the intermediate section 4, and another inclined face 7' is formed between the intermediate section 4 and the lower section 5, said lower section 5 opening at the lower end face 2*b* of the lower die 2. Vertically slidably inserted within the stepped bore 6 is a tubular knock-out 8 which is fitted to a movable member 9 of a knock-out mechanism (not shown).

A punch 11 is suspended from and fixedly secured to a slide 10 through an attachment member 12, a cylindrical holder 13 and a tightening member 14. Vertically slidably inserted in the inner peripheral surface of the holder 13 is a cylindrical member 15. The cylindrical member 15 includes an outer peripheral surface 15*a* of a lower section and an outer peripheral surface 15*b* of an upper section, and the diameter of the lower peripheral surface 15*a* is smaller than that of the upper peripheral surface 15*b* so as to form a shoulder 16 therebetween. The cylindrical member 15 is thus arranged to move downwards until the shoulder 16 thereof is allowed to abut against a flange 17 of the holder 13.

Fitted to the lower part of the above-mentioned cylindrical member 15 is an opposed relationship to the lower die 2 is an upper die 18 which has a longitudinally extending bore 19 formed coaxially with the stepped bore 6. The diameter of the bore 19 is larger than that of the intermediate section 4 and smaller than that of the hexagonal upper section 3, and the punch 11 is slidably disposed within the bore 19.

The above-mentioned punch 11 comprises a large diameter base portion 11*a*, a first small diameter portion 11*b* and a second small diameter portion 11*c*, the diameter of which is smaller than that of the portion 11*b*. A right-angle stepped portion 20 is formed between the large diameter base portion 11*a* and the first small diameter portion 11*b*, whilst a tapered stepped portion 21 is formed between the first small diameter portion 11*b* and the second small diameter portion 11*c*.

Reference numeral 22 denotes a plate abutting against the upper die 18, and 23 a sleeve mounted around the punch 11. A disk plate 23*a* is mounted around the sleeve 23. Disposed between the disk plate 23*a* and the plate 22 and between the disk plate 23*a* and the attachment member 12 are first and second elastic members $24_1$ and $24_2$ of urethane rubber or the like, respectively. Cushion pins 25 of a cushion cylinder not shown are arranged to abut against an upper end face 23*b* of the sleeve 23.

The process for manufacturing fittings by means of the apparatus according to the present invention will now be described hereinbelow.

Figure 2:
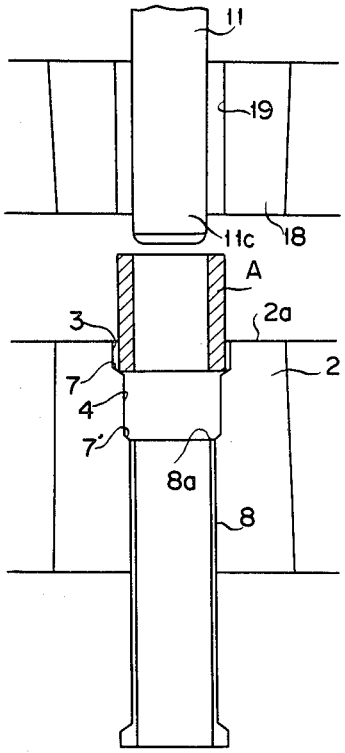
FIGS. 2 to 7 are explanational views showing how to manufacture a fittings according to the apparatus of the present invention.

A pipe-shaped blank "A" is inserted in the stepped bore 6 of the lower die 2 with the slide 10 raised as shown in FIG. 2.

At that time, the lower part of the pipe-shaped blank "A" abuts against the inclined surface 7, and its upper portion projects upwardly beyond the upper face 2*a* of the lower die 2, while the punch 11 is disposed with the leading end of the second small diameter portion 11*c* thereof projecting downwards slightly beyond the bore 19 of the upper die 18. Further, the upper end face 8*a* of the knock-out 8 is held flush with the lower end of the inclined surface 7'.

Figure 3:
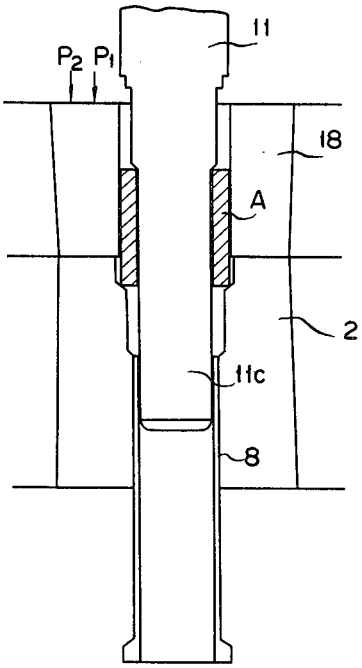

The slide 10 is thereafter moved downwards until the upper die 18 abuts against the lower die 2 as shown in FIG. 3. When the slide 10 is further moved downwards, the holder 13 will move downwards along the cylindrical member 15 so that the punch 11 may move further downwards with its second small diameter portion 11*c* passing through the inside of the blank "A" and being inserted in the knock-out 8.

Figure 4:
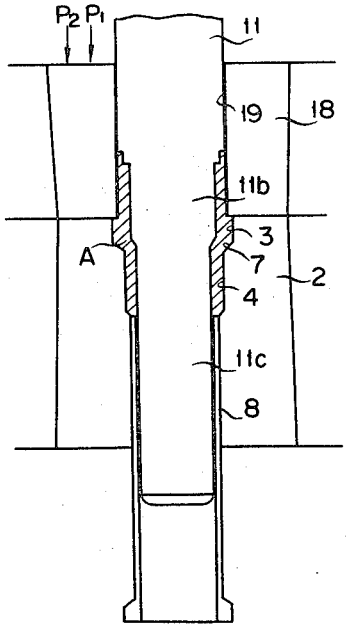

At that time, as shown in FIG. 4, a downward pressure $P_1$ is exerted on the upper die 18 through the cushion pins 25, and when the punch 11 is moved further downwards, the first and second elastic members 24, and $24_2$ are compressed so as to exert a further downward pressure $P_2$ on the upper die 18.

When the slide 10 is moved further downwards, the punch 11 will move further down to press the pipe-shaped blank "A" between the first small diameter portion 11*b* and the bore 19 of the upper die 18 and between the first small diameter portion 11*b* and the hexagonal bore section 3 of the lower die 2 and also between the second small diameter portion 11*c* and the intermediate bore section 4 so as to obtain a pressed fittings having a predetermined shape.

At that time, the aforementioned downward pressures $P_1$ and $P_2$ are exerted on the upper die 18 so as to prevent the formation of burrs in the boundary areas of the dies 18 and 2. In brief, the upper die 18 is urged against the lower die 2 without creating any clearance in the boundary areas thereof, and therefore the formation of burr can be prevented.

Figure 5:
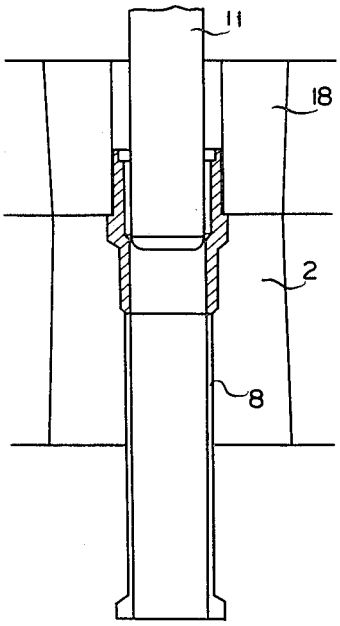

Subsequently, the slide 10 is moved upwards so that only the punch 11 may move upward, as shown in FIG. 5.

At that time too, the aforementioned pressures $P_1$ and $P_2$ are exerted on the upper die 18 so as to prevent the pressed article from sticking to the punch 11 and moving upwards together with it.

Figure 6:
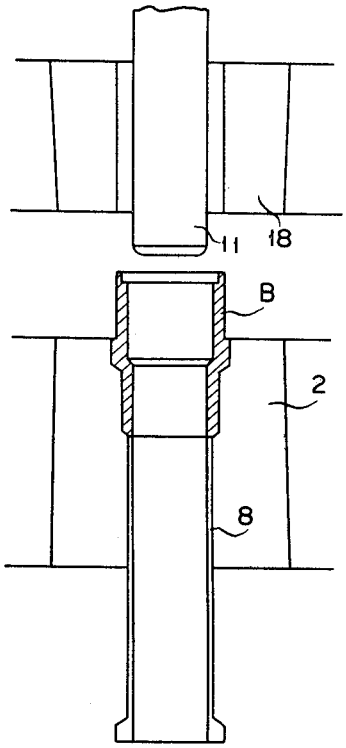
Figure 7:
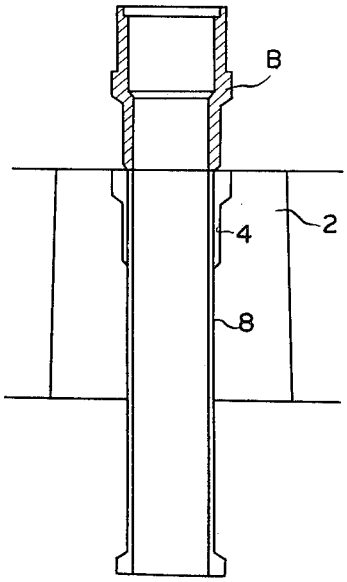

When the slide 10 is moved further upwards, the punch 11 is moved away from the pressed article, and then the upper die 18 is moved upwards, as shown in FIG. 6. The timing of such movement is previously set to give an amount $S_1$ for sliding cushion.

After that, the pressed article is moved out from the stepped bore 6 of the lower die 2 by the action of the knock-out 8.

Figure 8:
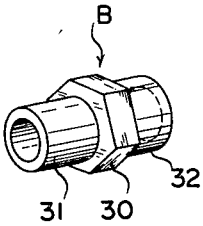
FIG. 8 is a perspective view of a manufactured fittings.

FIG. 8 is a perspective view of the pressed article or fittings "B" which is of a shape having cylindrical portions 31 and 32 on both sides of a hexagonal head portion 30.

Further, according to the press apparatus of the present invention, in order to prevent the generation of burrs of the pressed article, the first and second elastic member $24_1$ and $24_2$ are mounted so as to obtain an increased force urging against the upper die 18.

This is because the installation of only the cushion pins 25 requires increasing the capacity thereof and long cushion stroke requires a large amount of work, and the necessity of such large amount of work can be eliminated by the provision of the elastic members.

By only providing the first and second elastic members $24_1$ and $24_2$, a sufficient stroke cannot be obtained. A satisfactory effect can be obtained by the use of the elastic members and the cushion pin in combination.

It is to be understood that the foregoing description is merely illustrative of a preferred embodiment of the present invention, and that the scope of the invention is not to be limited thereto, but is to be determined by the scope of the appended claims.

What I claim is:

1. An apparatus for manufacturing fittings, comprising:

a bed;

a lower die mounted on said bed, said lower die having formed therein a stepped bore adapted to receive a cylindrical blank to be worked;

a hollow knockout slidably mounted in said stepped bore;

a slide;

holder means fixedly secured to said slide, said holder means having a first bore formed therein;

a cylindrical member slidably fitted in said holder means;

an upper die mounted in said cylindrical member, said upper die having a second bore formed therein;

a punch fixedly secured to said slide and inserted in the first and second bores of said holder means and said upper die;

a sleeve mounted on and around said punch;

cushion cylinder means for biasing said sleeve and said upper die downwards; and elastomer means disposed around said sleeve between said holder means and said upper die for biasing said upper die downwards after said upper die is lowered on said lower die.

2. An apparatus for manufacturing fittings as recited in claim 1 wherein said stepped bore comprises an upper section having a hexagonal shape in cross-section, an intermediate cylindrical section and a lower cylindrical section with a smaller diameter than that of the intermediate section and wherein said punch comprises an upper section, an intermediate section having a diameter smaller than that of the upper section but larger than the inner diameter of said hollow knockout, and lower section having a diameter smaller than that of the intermediate section and insertable in said hollow knockout.

3. An apparatus for manufacturing fittings as recited in claim 1 or 2 wherein said cylindrical member has a shoulder formed therein and said holder means comprises an attachment member and a cylindrical holder member, said cylindrical holder member having a flange formed at the lower end thereof, said shoulder and said flange being adapted to engage with each other when said slide is raised.

4. An apparatus for manufacturing fittings as recited in claim 1 or 2 wherein said elastomer means comprises a pair of elastomer rings juxtaposed in vertical direction.

* * * * *